United States Patent [19]

George et al.

[11] Patent Number: 4,655,298

[45] Date of Patent: Apr. 7, 1987

[54] ANNULUS PRESSURE FIRER MECHANISM WITH RELEASABLE FLUID CONDUIT FORCE TRANSMISSION MEANS

[75] Inventors: Flint R. George, Katy; David M. Haugen, Houston, both of Tex.

[73] Assignee: Halliburton Company, Duncan, Okla.

[21] Appl. No.: 773,773

[22] Filed: Sep. 5, 1985

[51] Int. Cl.[4] ..... E21B 43/116

[52] U.S. Cl. ..... 175/4.52; 166/55; 166/63

[58] Field of Search ..... 175/4.52, 4.54, 4.56; 166/55, 55.1, 63

[56] References Cited

U.S. PATENT DOCUMENTS 4,484,632 11/1984 Vann ..... 175/4.54
4,526,233 7/1985 Stout ..... 166/55
4,544,034 10/1985 George ..... 166/55.1
4,560,000 12/1985 Upchurch ..... 166/55.1

*Primary Examiner*—Stephen J. Novosad
*Assistant Examiner*—William P. Neuder
*Attorney, Agent, or Firm*—James R. Duzan

[57] ABSTRACT

A system for perforating a well with an annulus pressure firer is provided by the present invention. A pressure responsive means is positioned in a tubing string uphole a packer and includes a piston movable in response to a pressure differential between the upper annulus pressure and the pressure inside the tubing string. The movement of the piston is transferred through a second, concentric tubing string to a firing head on a perforating gun below the packer. The system includes a means for simultaneously decoupling the concentric tubing strings below the packer to drop the perforating gun to the bottom of the well.

9 Claims, 25 Drawing Figures

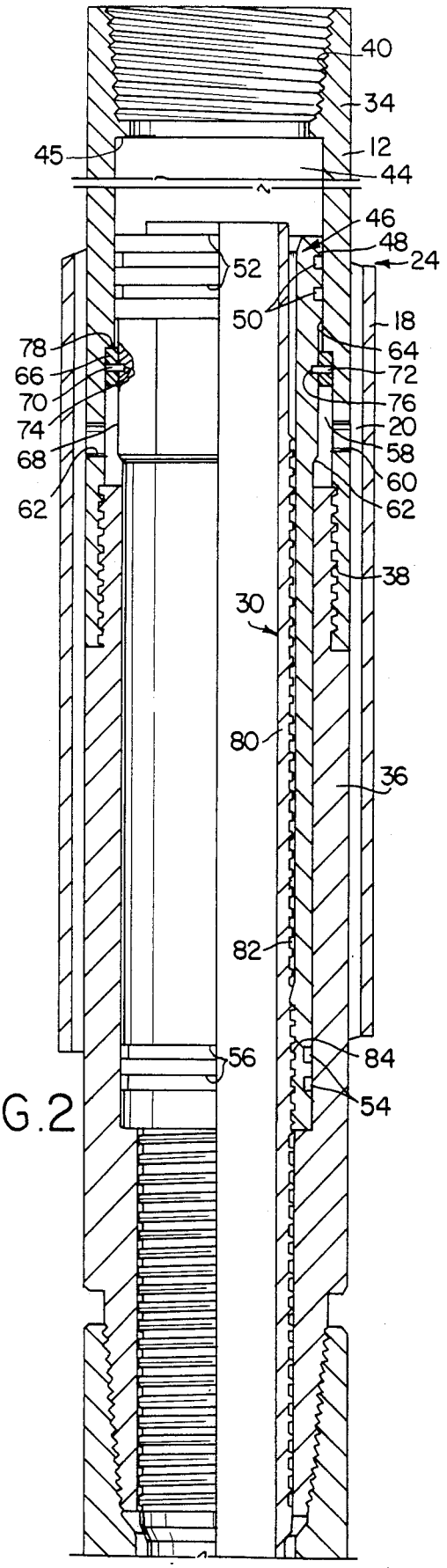
FIG. 2
FIG. 3
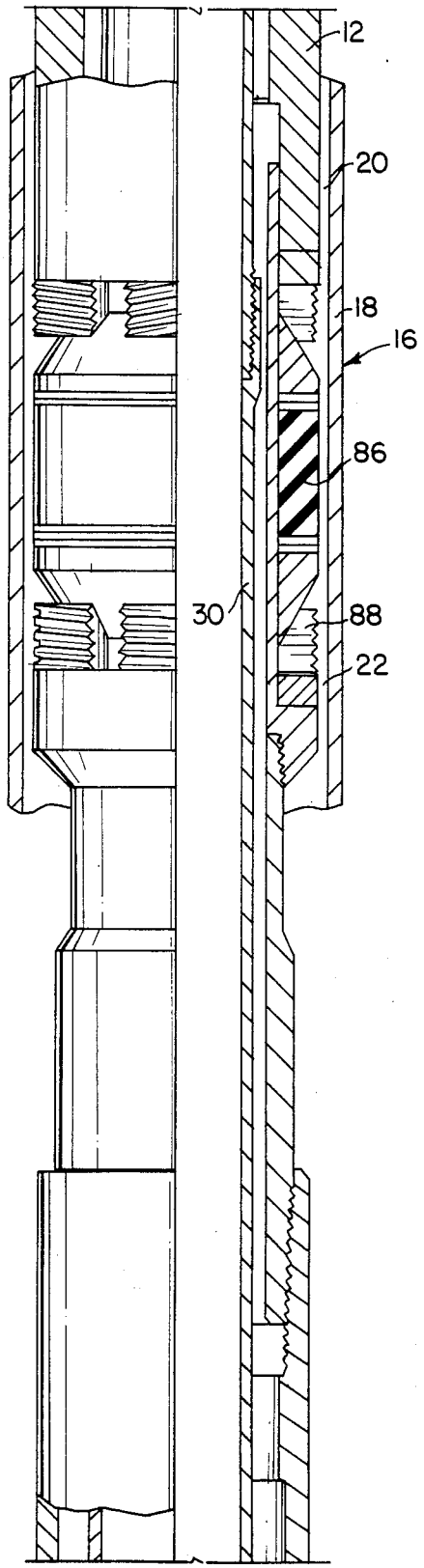

FIG. 9A
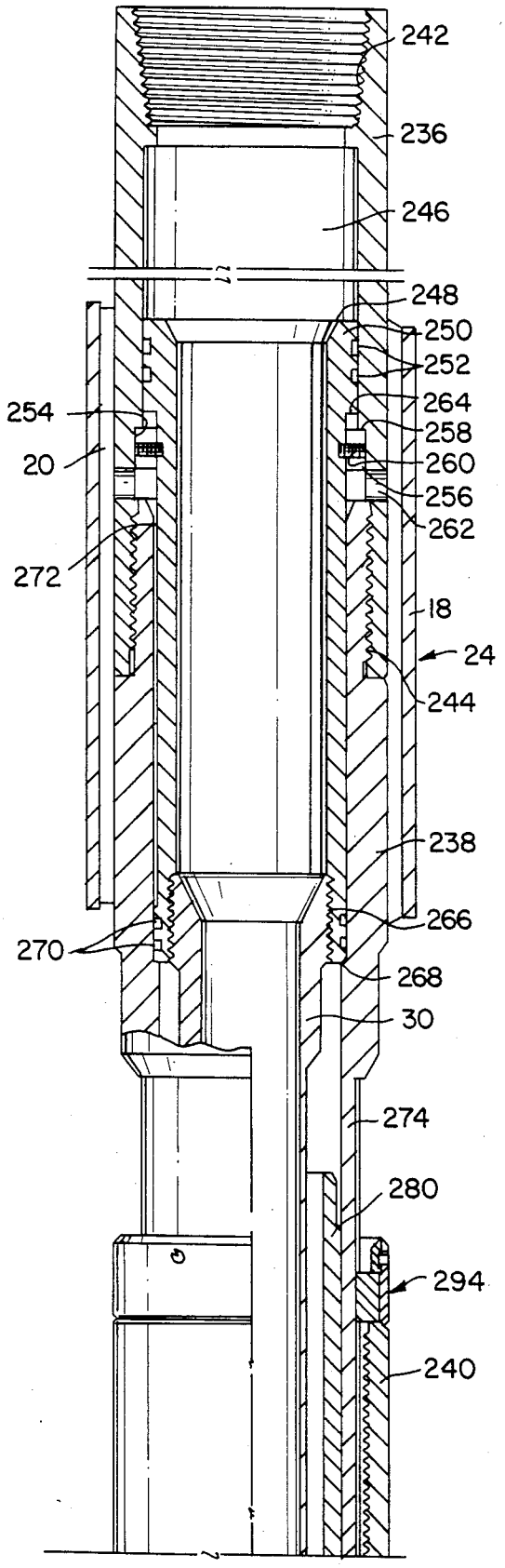
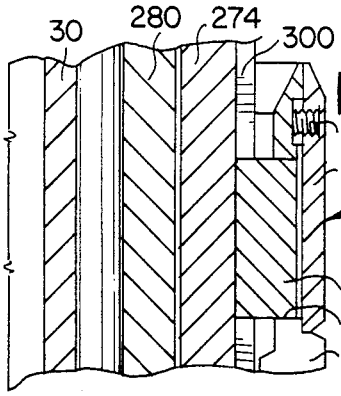
FIG. 10
FIG. 9B
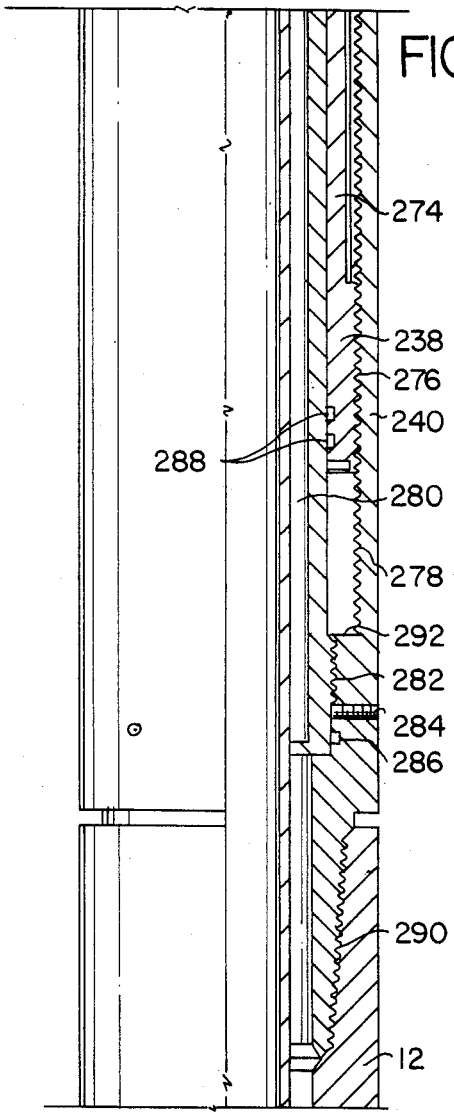

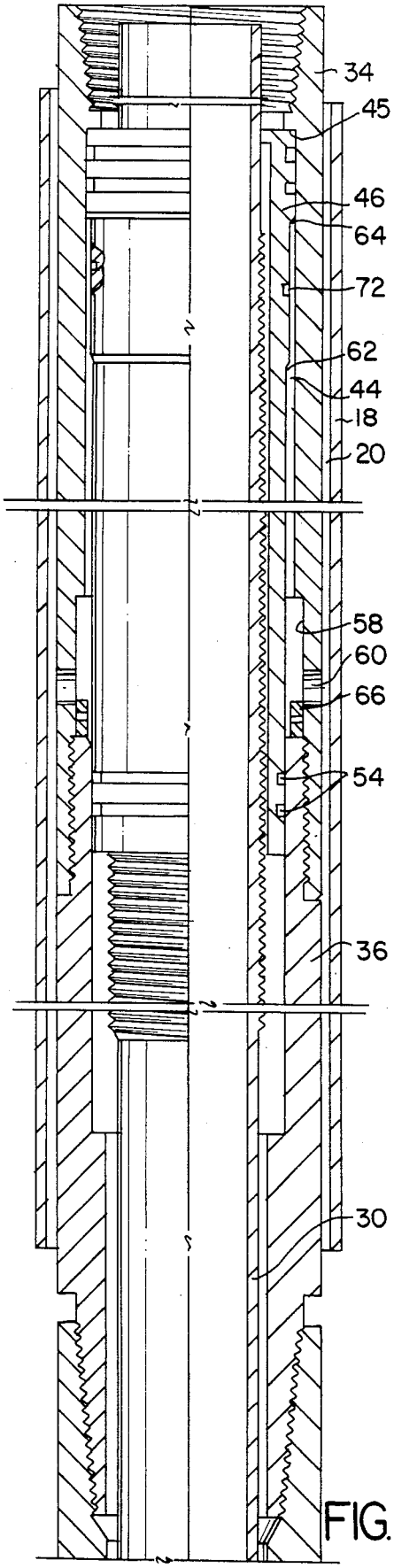
FIG.14
FIG. 15
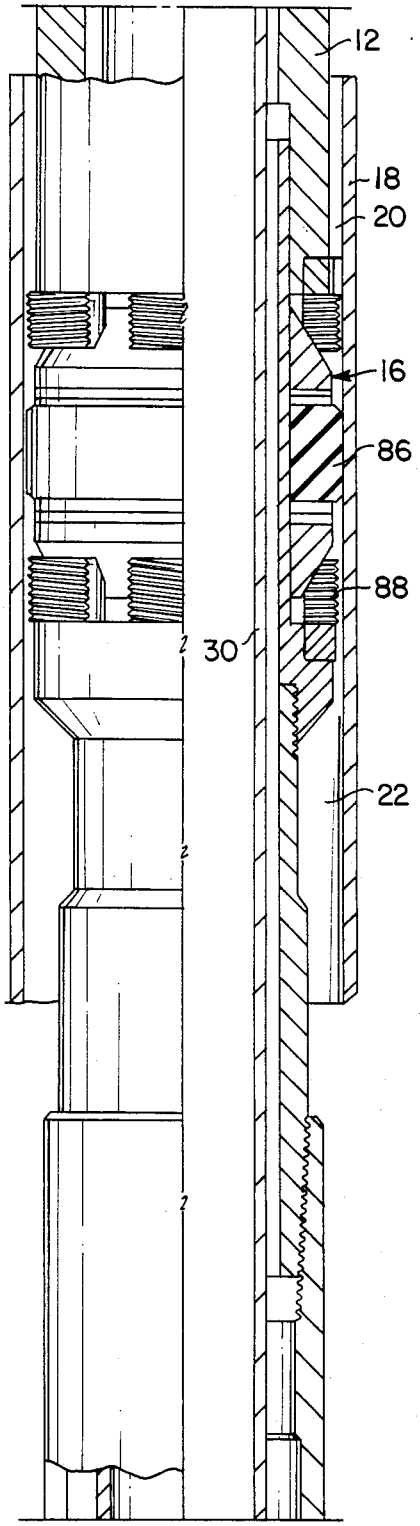

ANNULUS PRESSURE FIRER MECHANISM WITH RELEASABLE FLUID CONDUIT FORCE TRANSMISSION MEANS

BACKGROUND

The present invention relates generally to methods and apparatus for use in well completion operations, and more particularly, relates to annulus pressure fire mechanisms for perforating guns. More particularly, the invention relates to a tubing actuated firer and to a method of releasing the tubing to drop the gun.

Oil and gas wells are generally completed by lowering a perforating gun into a cased borehole to perforate the well by shooting perforations through the casing, cement and into the hydrocarbon formation to permit the hydrocarbons to flow into the cased borehole and up to the surface. U.S. Pat. Nos. 3,706,344 and 4,484,632 to Vann, disclose suspending a packer and perforating gun on a tubing string, setting the packer to isolate the production zone, releasing the trapped pressure below the packer by opening the tubing string to fluid flow, actuating the perforating gun through the tubing string, and immediately producing the well through the tubing string upon perforation. One means for actuating the perforating gun includes dropping a bar through the tubing string to impact the firing head of the perforating gun.

However, after a borehole has been drilled into the ground and the casing cemented into position, well fluids fill the cased borehole with drilling mud and debris which gravitate toward the lower end of the cased borehole and tend to densify and congeal into a heavy layer of material. Additionally, debris such as rust, sand, scale, and other material dropped into the well from the surface also tend to collect and densify toward the bottom of the well. This material often collects around the firing head of the perforating gun.

In a perforating gun having a bar actuated gun firing head, it is possible for such contaminants to densify and collect such that the firing head cannot be sufficiently impacted to detonate the perforating gun. If the bar is unable to sufficiently strike the firing mechanism, the gun will not be detonated. The problem of debris and contamination is compounded when the string is left downhole for a substantial length of time.

In an effort to overcome these problems associated with bar actuated firing mechanisms, systems such as those disclosed in U.S. Pat. No. 4,484,632 to Vann were developed. These systems use an annulus pressure firing mechanism. In an annulus pressure firer, a pressure responsive means is disposed in the pipe string above the packer and is connected by means of a cable or a tube containing hydraulic fluid to the firing head on top of the perforating gun. With this system, the gun is actuated by a differential pressure created between the interior of the tubing and the well annulus. This eliminates the need to run a bar or other mechanism down the tubing to actuate the gun, which mechanism could be hindered by the collection of mud or other debris.

While the annulus pressure fire mechanism was an advancement over many of the previous designs, it still possesses certain problems. For example, the cable or tubing connecting the pressure responsive means above the packer with the firing head often prevented the lowering of other tools and equipment such as logging tools down the tubing to the top of the firing head. Rather, these tools could generally only be lowered as far as the pressure responsive means which was located above the packer. Accordingly, what is needed in the art is an annulus pressure firer mechanism which allows the tubing to remain opened such that other tools can be lowered down to the firing head.

After a perforating gun has been lowered into a well, it is often desirable to separate the gun from the end of the tubing and drop it to the bottom of the well. This is often necessary to drop the gun if a logging tool or sampling equipment needs to be lowerd through the tubing to a point below where the gun is located. Also, during production it is often desirable to drop the gun to completely open the end of the tubing to allow the oil and gas to flow unimpeded into the tubing.

Accordingly, it would be desirable to have a release mechanism in conjunction with an annulus pressure fire mechanism which would allow the tubing to be separated above the perforating gun such that the gun could be dropped to the bottom of the well.

The present invention provides apparatus and methods which can accomplish these functions.

SUMMARY OF THE INVENTION

The present invention provides an annulus pressure firer mechanism for use in a system for perforating a well. The system includes a tubing string which is suspended within a well bore with a perforating gun suspended on the end thereof. A firing head is positioned on the tubing string immediately above the perforating gun.

A packer on the tubing string divides the annulus formed between the well bore and the tubing string into upper and lower sections with the perforating gun being located in the lower section. The system includes a means for communicating the interior of the tubing with the lower annulus section.

A pressure responsive means is included in the tubing above the packer and is operable in response to a pressure differential created between the upper annulus and the interior of the tubing. The pressure in the interior of the tubing is equal to the lower annulus pressure. In a preferred embodiment, the pressure responsive means comprises a slidable piston positioned within a chamber formed in the first tubing string.

The pressure responsive means is connected by means of a second inner tubing string, concentric with the first tubing string, to the firing head on top of the perforating gun. The second tubing string transmits the force from the pressure responsive means to the firing head for activating the perforating gun.

The present invention also includes a system for simultaneously detaching the first and second concentric tubing strings above the perforating gun such that the gun can be dropped to the bottom of the well. The first and second tubing strings include detachable couplings dividing the tubing into upper and lower sections. A movable sleeve is positioned between the first and second tubing strings adjacent the couplings for releasing the lower sections.

As the movable sleeve is slid within a chamber formed between the tubing strings, collet fingers on the detachable couplings are released allowing the lower tubing sections to fall to the bottom of the well with the perforating gun.

In one embodiment, the movable sleeve includes a plurality of lugs which extend through the second tubing string towards the center of the tubing. These lugs can be engaged by a positioning tool lowered on a wireline or slickline into the well. The slickline can then be raised causing the sleeve to shift and detach the tubing.

Additional features and advantages of the invention will become more fully apparent from the following detailed description and claims taken in conjunction with the attached drawings.

BRIEF DESCRIPTION OF THE DRAWINGS

FIG. 2 depicts a preferred embodiment of the pressure responsive means of the present invention shown in partical vertical cross-section.

FIG. 3 illustrates a packer which can be used with the present invention shown in partical vertical cross-section.

FIGS. 9A and 9B depict a second preferred embodiment of a pressure responsive means in accordance with the present invention illustrated in partical vertical cross-section.

FIG. 10 illustrates in greater detail a locking means utilized in the pressure responsive means illustrated in FIG. 9A.

FIG. 14 depicts the pressure responsive means of FIG. 2 in the deployed mode.

FIG. 15 depicts the packer of FIG. 3 in the deployed mode.

DETAILED DESCRIPTION OF THE PREFERRED EMBODIMENT

The present invention provides a novel apparatus and method for completing a well using an annulus pressure firer system. The invention is best understood by reference to the accompanying drawings in which like parts are designated with like numerals throughout.

Figure 1A:
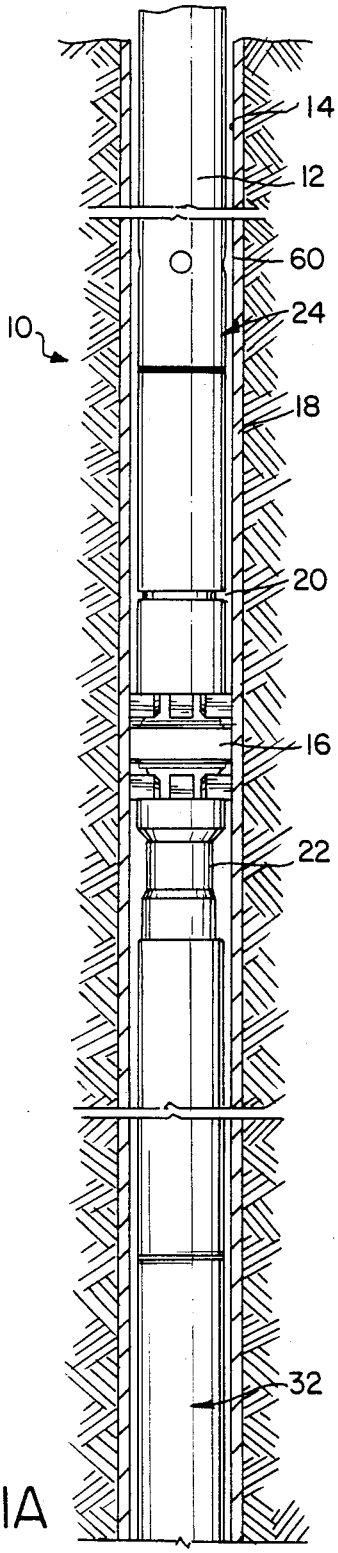
FIGS. 1A and 1B schematically illustrates the various components of the present invention as they are suspended within a well.
Figure 1B:
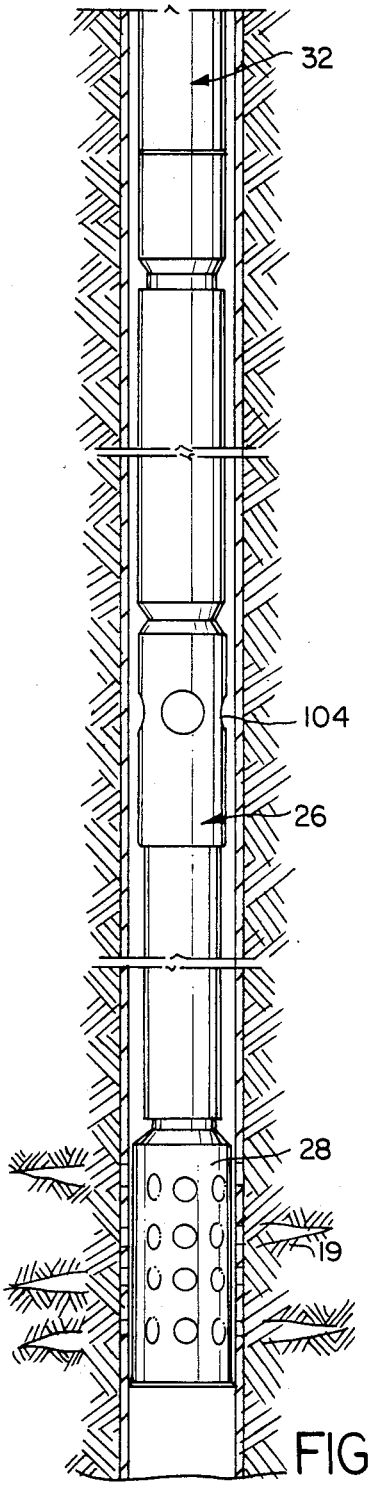

Reference is first made to FIG. 1 in which an annulus pressure firer system according to the teachings of the present invention is generally designated at 10. Firer system 10 is suspended on a tubing string 12 within a well 14. Firer system 10 includes a packer 16 which divides the annulus formed between tubing string 12 and casing 18 into an upper annulus section 20 and a lower annulus section 22. As more fully described hereinafter, the interior of tubing string 12 is in fluid communication with lower annulus section 22. Accordingly, a pressure differential can be created between upper annulus section 20 and the interior of tubing string 12.

A pressure responsive means 24 is positioned in tubing string 12 above packer 16. As discussed further below, pressure responsive means 24 is actuated in response to a pressure differential created between upper annulus section 20 and the interior of tubing string 12 to actuate the firing mechanism.

A firing head 26 is positioned on top of a perforated gun 28 which is suspended on the bottom of tubing string 12. Firing head 26 is connected to pressure responsive means 24 by means of an inner tubing string 30 (see FIG. 2) which is concentric with and positioned within tubing string 12. As pressure responsive means 24 is activated in response to a pressure differential, it raises inner tubing string 30 within tubing string 12 causing firing head 26 to actuate perforating gun 28 to form perforations through casing 18 and into the hydrocarbon containing formation 19.

A detachable coupling section 32 is positioned in tubing string 12 above firing head 26. Coupling section 32 can be operated to separate the lower portion of tubing string 12 along with firing head 26 and perforating gun 28 from the remainder of tubing string 12. This allows perforating gun 28 to be dropped to the bottom of the well to open the bottom of tubing string 12. This can be desirable for anyone of a number of reasons.

For example, it is often desirable to open the end of the tubing to allow freer production or to permit other tools such as logging tools to be lowered into the bottom of the well past the point where the perforating gun was suspended.

Coupling section 32 is designed such that it will release both inner tubing string 30 and tubing string 12 in a single continuous step.

Reference is next made to FIG. 2 which illustrates a preferred embodiment of pressure responsive means 24. Pressure responsive means 24 is formed in tubing string 12 and includes an upper section 34 and a lower section 36 which are threadably connected at 38. Upper section 34 includes threads 40 such that it can be connected to additional sections of tubing string 12. Lower section 36 includes threads 42 on its downhole end so that it can be connected to additional sections of tubing string 12.

An axial chamber 44 is formed in pressure responsive means 24. The diameter of the portion of axial chamber 44 in upper section 34 is slightly greater than the diameter of chamber 44 in lower section 36.

A piston 46 is positioned within axial chamber 44. Piston 46 includes an enlarged head 48 which is equal in diameter to the portion of axial chamber 44 located in upper section 34. O-rings 50 are placed in annular grooves 52 formed in head 48 to seal head 48 against the sides of axial chamber 44. O-rings 54 are placed in annular grooves 56 formed in the downhole portion of piston 46 to seal the lower end of piston 46 against the walls of chamber 44 formed in lower section 36.

Annular chamber 44 is enlarged below head 48 of piston 46 to form an annular chamber 58. Annular chamber 58 is connected by means of ports 60 and 62 to upper annulus section 20. Accordingly, fluid within annulus section 20 can freely flow into and out of annular chamber 58.

The fluid and pressure in annular chamber 58 is isolated from the fluid and pressure in axial chamber 44 by O-rings 50 and 54. If the pressure in annular chamber 58 exceeds that in axial chamber 44, the fluid will act upon shoulders 62 and 64 to cause piston 46 to move upward within axial chamber 44.

In order to prevent unwanted movement of piston 48, a ring 66 is positioned around intermediate portion 68 of head 48. Ring 66 is connected to intermediate portion 68 by shear pins 70 and 72 which extend through ring 66 and into recesses 74 and 76 in intermediate portion 68. Accordingly, when the pressure in upper annulus section 20 exceeds the pressure within tubing string 12 by a predetermined amount, it will act upon shoulders 62 and 64 to cause piston 46 to sever shear pins 70 and 72 and rise within axial chamber 44.

Ring 66 abuts shoulder 78 formed in the top of annular chamber 58 to keep it from rising and thus allow pins 70 and 72 to hold piston 46 in place until the predetermined pressure differential is reached.

Inner tubing string 30 includes a mandrel 80 on the upper portion thereof. The outer surface of mandrel 80 is threaded at 82 along essentially the entire length thereof. Threads 82 engage threads 84 formed on the interior downhole surface of piston 46. Accordingly, piston 46 is connected to inner tubing string 30 through mandrel 80. Additionally, since mandrel 80 is threaded along essentially the length thereof, its position within piston 46 can be adjusted during assembly such that inner tubing string 30 is in the correct position to engage the firing head as discussed further below.

Referring now to FIG. 3, tubing string 12 is shown in partial longitudinal section and has a packer 16. Packer 16 has a packing element 86 and slips 88 for engaging the sides of a casing 18. In the preferred embodiment, packer 16 is a setdown-type packer, many suitable embodiments of which are well known in the art. Inner tubing string 30 extends down through tubing string 12 past packer 16.

Figure 4A:
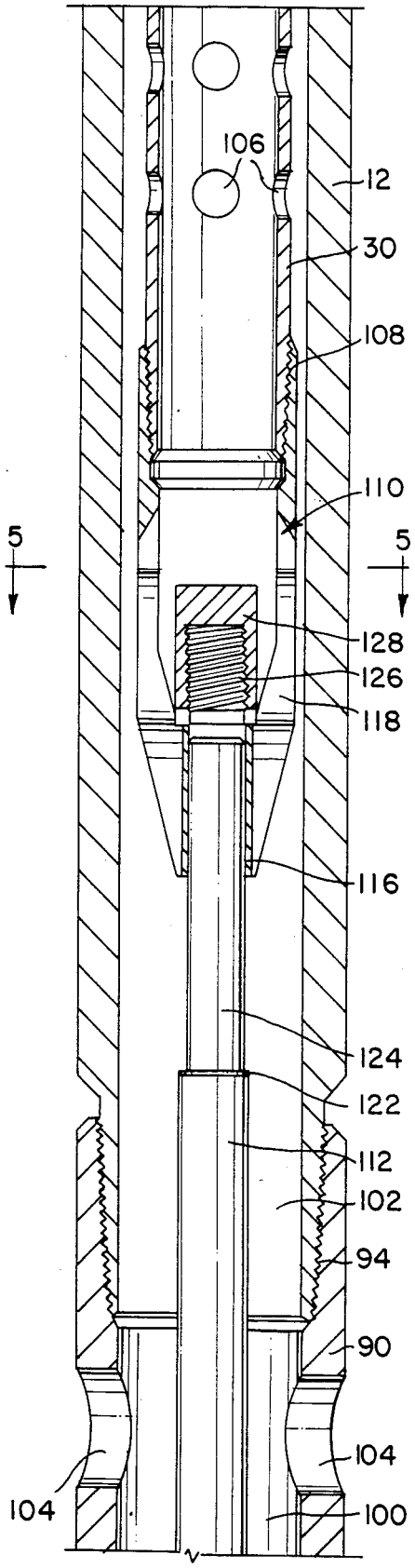
FIGS. 4A and 4B depict a preferred embodiment of a firing head of the present invention illustrated in vertical cross-section.
Figure 4B:
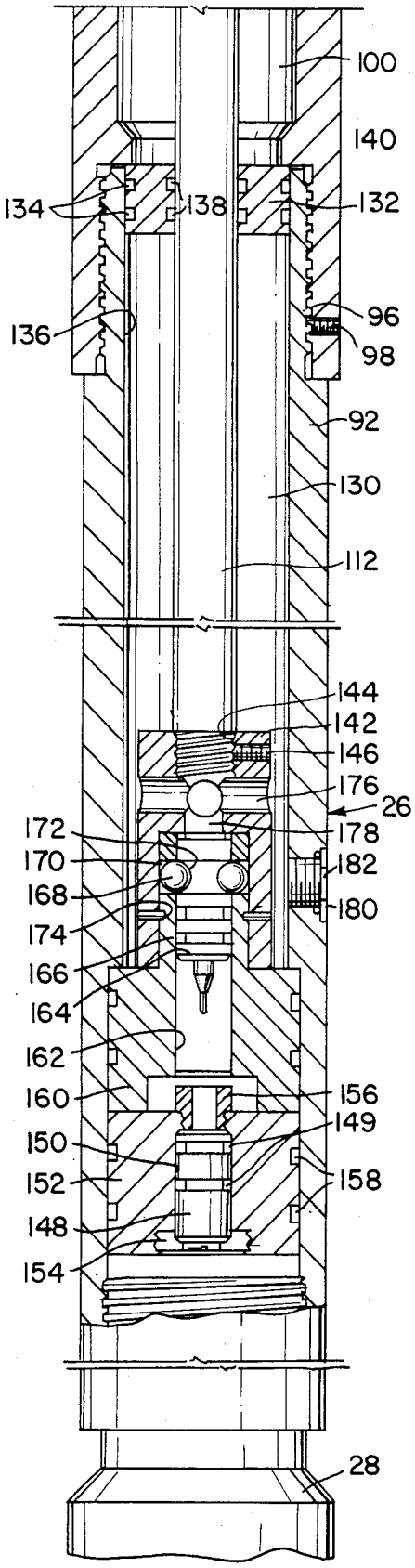

Referring now to FIGS. 4A and 4B, firing head 26 is illustrated in vertical cross-section. Firing head 26 includes upper and lower housing members 90 and 92. Upper housing member 90 is coupled directly to tubing string 12 by threads 94. Housing members 90 and 92 are held together by threads 96 and secured in place by a setscrew 98.

Upper housing member 90 includes an inner chamber 100 which is in fluid communication with the interior 102 of tubing string 12. Ports 104 formed in housing member 90 communicate inner chamber 100 with lower annulus section 22 (see FIG. 1) formed between the well casing 18 and tubing string 12. The downhole end of inner tubing string 30 includes a plurality of ports 106 which place the interior 102 of inner tubing string 30 in fluid communication with the interior of tubing string 12. It is through inner tubing string 30 that the upper portion of tubing string 12 above pressure responsive means 24 is in fluid communication with the lower portion of tubing string 12.

The downhole end of inner tubing string 30 is threaded at 108 to receive acoupler 110. Coupler 110 connects inner tubing string 30 with pull rod 112 which activates firing head 26.

Figure 6:
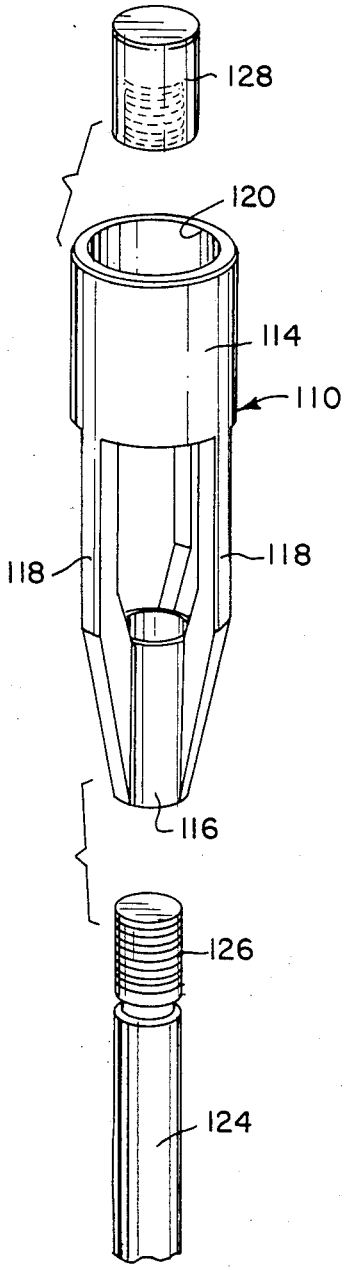
FIG. 6 is an exploded perspective view of a coupler used in the firing head of the embodiment illustrated in FIG. 4A.

Coupler 10 is illustrated more clearly in an exploded perspective view in FIG. 6. Coupler 110 includes an upper collar 14 and a lower collar 116. Collars 114 and 116 are connected by a plurality of fingers 118. The interior of upper collar 114 includes threads 120 such that it can be connected to inner tubing string 30 at 108.

Referring again to FIG. 4A, the upper portion of pull rod 112 is tapered at 122 to form a section 124 of reduced diameter. The uphole end of section 124 is threaded at 126 to receive a cap 128. The interior surface of lower collar 116 is smooth such that it can freely slide over section 124.

During assembly, collar 116 is placed over section 124 and coupler 110 is slid down until it engages taper 122. This exposes threads 126 such that cap 128 can be attached to the top of pull rod 112. During operation, as inner tubing string 30 is raised, it pulls coupler 110 upward until lower collar 116 engages cap 128 which then causes pull rod 112 to be lifted upward activating firing head 26.

Figure 5:
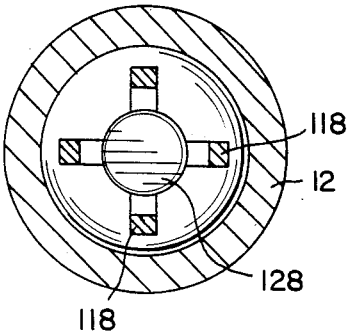
FIG. 5 is a horizontal cross-section of the firing head taken along line 5—5 of FIG. 4A.

FIG. 5 illustrates tubing string 12 and coupler 110 shown in cross-section as taken along lines 5—5 of FIG. 4A.

Fluids which are contained within interior 102 of tubing string 12 can flow into inner tubing string 30 through the openings between fingers 118 of coupler 10 as well as through ports 106 which are formed in inner tubing string 30. The size and number of parts 106 and the openings between fingers 118 are designed such that the sum of their areas is approximately equal to the cross-sectional area of inner tubing string 30.

Referring again to FIG. 4B, lower housing member 92 of firing head 26includes an inner chamber 130. Inner chamber 130 is filled with a substantially noncompressible fluid and is sealed at the top by a piston 132. Piston 132 includes O-rings 134 which seal piston 132 against inner surface 136 of lower housing member 92. O-rings 138 seal piston 132 against pull rod 112. The upward movement of piston 132 is limited by shoulder 140 formed in the lower end of upper housing member 90. As firing head 26 is lowered into a well, well fluids enter through ports 104 into upper housing member 90 such that they fill inner chamber 100. These fluids then exert a pressure against piston 132 which transmits that pressure to the fluid in inner chamber 130 in lower housing member 92.

A retaining cap 142 is threadably secured at 144 to the downhole end of pull rod 122. A set screw 146 retains cap 142 on pull rod 112. When retaining cap 142 is raised, firing head 26 is activated.

A charge retainer 152 is positioned in the lower end of housing member 92. A detonating charge 148 is located in an axial bore 150 in charge retainer 152 and is scaled in place by O-rings 149. Detonating charge 148 is held within retainer 152 by a stop nut 154. A shock absorber 156 is threadably secured in retainer 152 above detonating charge 148. O-rings 158 provide a seal between charge retainer 152 and the sides of lower housing member 92.

A firing pin retainer 160 is positioned in lower housing member 92 immediately above charge retainer 152. A firing pin 164 is positioned within a central bore 162 formed in retainer 160. The upper portion 166 of firing pin retainer 160 has a reduced outside diameter. Firing pin 164 is held within upper portion 166 by a plurality of steel balls 163 which are positioned within ports 170 in upper section 166 and engage peripheral recess 172 formed in firing pin 164.

Retaining cap 142 fits over upper portion 166 and holds steel balls 168 within ports 170. Retaining cap 142 is held in position over upper portion 166 by a plurality of shear pins 174.

A plurality of ports 176 formed in retaining cap 142 and connect with an axial bore 178 formed therein. Bore 178 opens directly on top of firing pin 164. Accordingly, the pressurized fluid contained in inner chamber 130 can enter through ports 176 and exert a force upon the top of firing pin 164 urging it downward toward detonating charge 148. However, steel balls 168 prevent the downward movement of firing pin 164 as long as retaining cap 142 is in place.

A plug 180 is positioned in lower housing member 92 and includes a rupture disk 182. If it becomes necessary to remove firing head 26 from a well without the perforating gun having been fired, rupture disk 182 helps prevent any misfiring from occurring. For example, if piston 132 becomes stuck causing a high pressure to be maintained within inner chamber 130, this pressure will be released through rupture disk 182 as firing head 26 is removed so that pressure will not be exerted on top of firing pin 164.

Figure 7A:
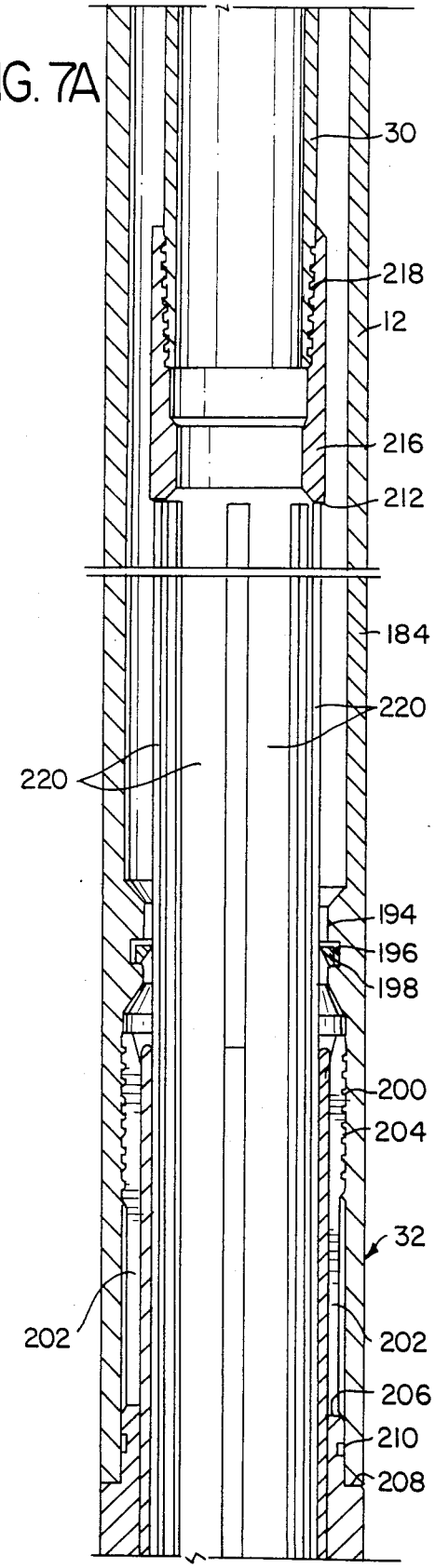
FIGS. 7A and 7B illustrate a preferred embodiment of the detachable coupling section of the present invention shown in partical vertical cross-section.
Figure 7B:
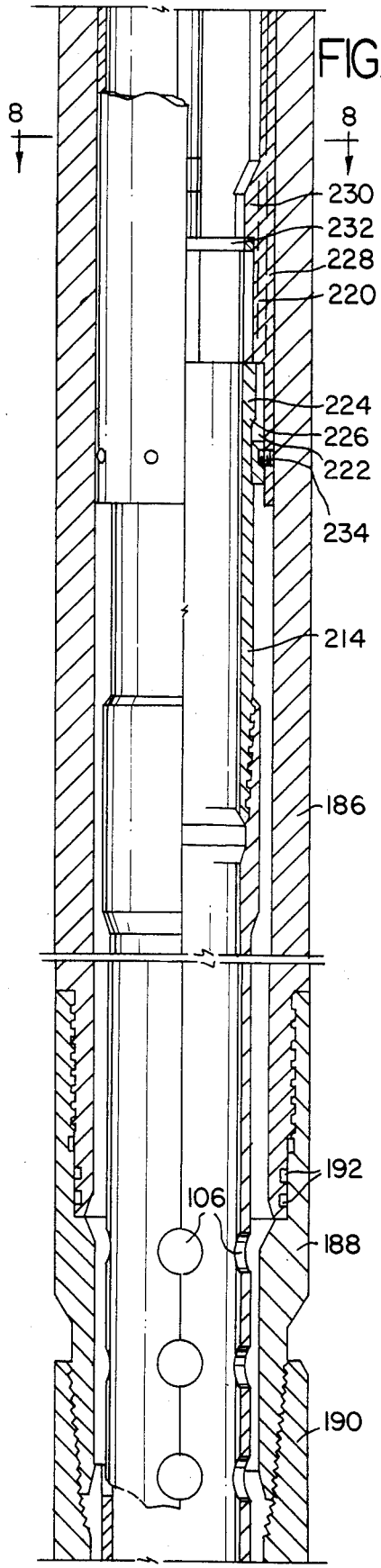

Reference is next made to FIGS. 7A and 7B which illustrate detachable coupling section 32 in a partial cross-section. Detachable coupling section 32 is designed such that both tubing string 12 and inner tubing string 30 can be divided to uphole and downhole sections such that the downhole section can be dropped to the bottom of the well along with the perforating gun and firing head.

Tubing string 12 includes an uphole section 184 and a downhole section 186. Uphole section 184 is threadably secured to additional lengths of outer tubing 12. Downhole section 186 is connected by means of sub 188 to a piece of tubing 190 which is connected to the upper portion of firing head assembly 26. Downhole section 186 is sealingly engaged with sub 188 by O-rings 192.

The interior of uphole section 184 includes a portion of reduced diameter 194 having an annular groove 196 formed therein. A split-ring 198 is positioned within annular groove 196 to act as a retainer as more fully described hereinafter. Below section 194, the inner surface of uphole section 184 includes a serrated surface 200.

Downhole section 186 includes a plurality of collet fingers 202 which includes serrated surfaces 204 for engaging serrated surface 200 in uphole portion 184. Collet fingers 202 are connected to lower section 186 at 206.

The lower end of uphole section 184 abuts shoulder 208 of downhole section 186. An O-ring 210 seals the joint between uphold section 184 and downhole section 186.

Inner tubing string 30 also includes an uphole section 212 and a downhole section 214 within detachable coupling section 32.

Uphole section 212 includes a collar 216 which is threadably connected to inner tubing string 30 at 218. A plurality of collet fingers 220 extend downwardly from collar 216 and terminate in inwardly extending lugs 222. Inwardly extending lugs 222 enage an outwardly extending rim 224 on downhole section 214 at 226.

Collet fingers 220 are normally biased outward but are prevented from flaring out by a sleeve 228 which is positioned between inner tubing string 30 and tubing string 12. Sleeve 228 also prevents collet fingers 202 on tubing string 12 from springing inward towards their normally biased position.

Figure 8:
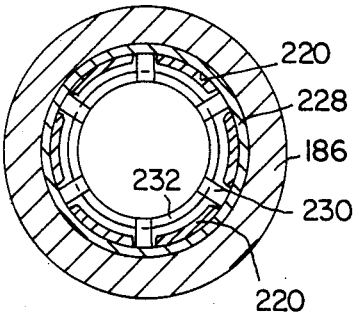
FIG. 8 is a horizontal cross-section of the detachable coupling section taken along line 8—8 of FIG. 7B.

Sleeve 228 includes a plurality of lugs 230 which extend inward between collet fingers 220. A ring 232 is positioned on the bottom of lugs 230 on the inside of collet fingers 220. This arrangement is shown in greater detail in FIG. 8 which is a cross-sectional view taken along line 8—8 of FIG. 7B.

Sleeve 228 is held in position by a plurality of shear pins 234 which extend through sleeve 228 and into lugs 222 on the end of collet fingers 220.

Reference is next made to FIGS. 9A and 9B which illustrate a second preferred embodiment of pressure responsive means 24. In this embodiment, the pressure responsive means 24 is formed in three sections in tubing string 12. These include an upper section 236, a middle section 238, and a lower section 240. Upper section 236 includes threads 242 for connection to the remainder of tubing string 12. The lower end of upper section 236 is threaded such that it engages a threaded portion of middle section 238 at 244.

Upper section 236 includes an interior chamber 246. A piston 248 is positioned within chamber 248. Piston 248 includes a head portion 250 which engages the walls of upper section 236. O-rings 252 form a seal between head portion 250 and upper section 236.

The lower end of upper section 236 has an enlarged bore 254. A ring 256 is placed in enlarged bore 254 such that it abuts shoulder 258. Ring 256 is secured to piston 248 by shear pins 260. A plurality of ports 262 are formed in upper section 236 such that they placed enlarged bore 254 in fluid communication with upper annulus section 20 formed between tubing string 12 and casing 18. The fluid which is in upper annulus section 20 can pass through ports 262 and into enlarged bore 254. At this point, the fluid can bypass ring 256 and engage shoulder 264 formed on the bottom of head portion 250 of piston 248. When this pressure exceeds the pressure inside tubing string 12 by a predetermined amount, it will cause piston 246 to rise severing shear pins 260.

The interior of piston 248 is threaded at the bottom end at 266 such that inner tubing string 30 can be attached thereto.

Middle section 238 of pressure responsive means 24 includes an interior shoulder 268 which engages the bottom of piston 248 to prevent it from falling down in tubing string 12. Two O-rings 270 provide a seal between the outer surface of the lower end of piston 248 and the inner surface of middle section 238. A wiper ring 272 is formed in piston 248 just below the top of middle section 238.

Middle section 238 has a central, tubular portion 274 which extends down into lower section 240. The bottom end of middle section 238 is threaded at 276 to engage threads 278 formed on the interior surface of lower section 240. Threads 278 extend substantially along the entire length of the interior of lower section 240. A sleeve 280 is positioned within lower section 240 in such a manner that it leaves a space for the tubular portion of 278 to extend down between sleeve 280 and lower section 240. Sleeve 280 is threaded onto lower portion 240 at 282. It is held in this position by set screw 284 and a seal is formed between sleeve 280 and lower section 240 by O-ring 286. O-rings 288 are positioned in annular grooves formed in the lower end of tubular portion 274 to form a seal between middle section 238 and sleeve 280.

During assembly, the last connection to be made is a joint 290 between lower section 240 and the remainder of tubing string 12. This embodiment of the present invention is designed to prevent the turning of the interior components as joint 290 is assembled. Lower section 240 is first screwed up onto threads 276 of tubular portion 274 until tubular portion 274 abuts shoulder 292 in lower section 240. Lower section 240 is then screwed into tubing string 12 at joint 290. The threads of joint 290 and the threads 276 and 278 are formed in opposite directions. Accordingly, as joint 290 is formed, lower section 240 and sleeve 280 which is attached thereto, are partially unscrewed from tubular portion 274 until it reaches the position illustrated in FIG. 9B.

Once lower section 240 has been screwed into place, it is held in a locked position by locking means 294. Locking means 294 is illustrated in greater detail in FIG. 10. Locking means 294 includes a plurality of lugs 296 which are inserted through slots 298 formed in lower section 240. Lugs 296 extend into slots 300 formed in tubular portion 274. A ring 302 is then placed around lower section 240 above slots 298 to prevent lugs 296 from falling out. Ring 302 is held in place by a set screw 304.

Figure 11:
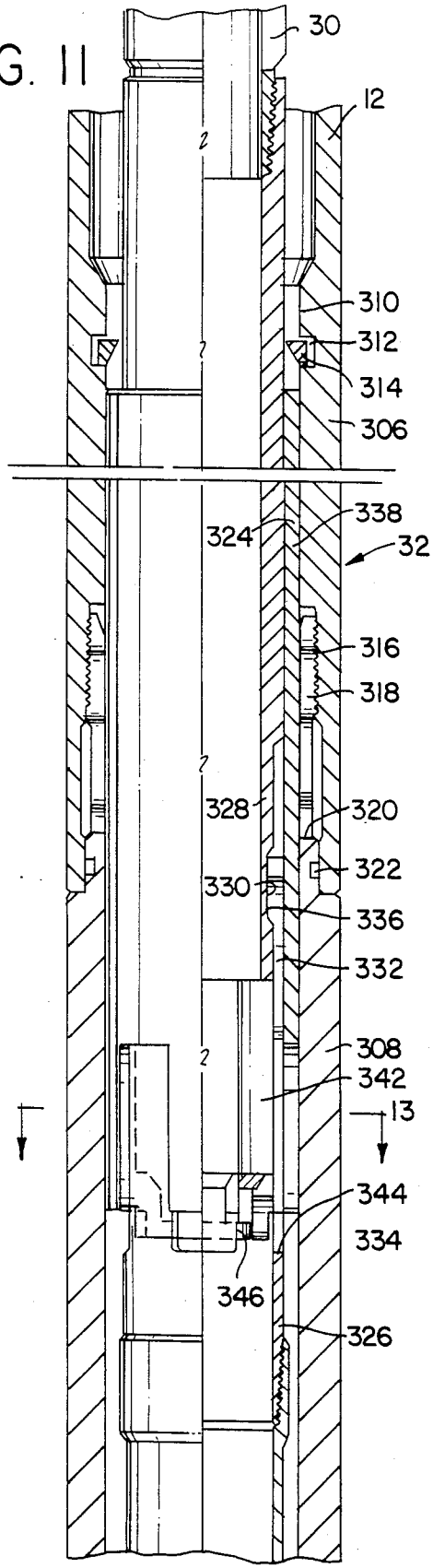
FIG. 11 depicts a second preferred embodiment of a detachable coupling section of the present invention illustrated in partical vertical cross-section.

Reference is next made to FIG. 11 which illustrates a second preferred embodiment of detachable coupling section 32 in vertical cross-section. This coupling section is designed such that the collet fingers on both the inner and outer tubing strings are on the downhole sections such that the fall to the bottom of the well when the coupling is released. This prevents the collet fingers from becoming entangled with any equipment which is lowered through the tubing strings after the couplings have been detached.

In this embodiment, tubing string 12 includes an uphole section 306 and a downhole section 308. Uphole section 306 has a bore running therethrough which includes a portion of reduced diameter 310. An annular group 312 is formed in portion 310 and holds a split ring 314.

The lower end of uphole section 306 is serrated at 316 for engaging collet fingers 318 formed on the top of downhole section 308. Collet fingers 318 are joined to downhole section 308 at 320. A seal is formed between uphole section 306 and downhole section 308 by O-ring 322.

Inner tubing member 30 is also formed from an uphole section 324 and a downhole section 326. Uphole section 324 has a lower portion of reduced diameter 328 with an annular groove 330 formed therein. Collet fingers 332 are formed on the top of downhole section 326 and are joined to downhole section 326 at 334. Collet fingers 332 include lugs 336 which engage annular groove 330 formed in upper section 324.

Figure 12:
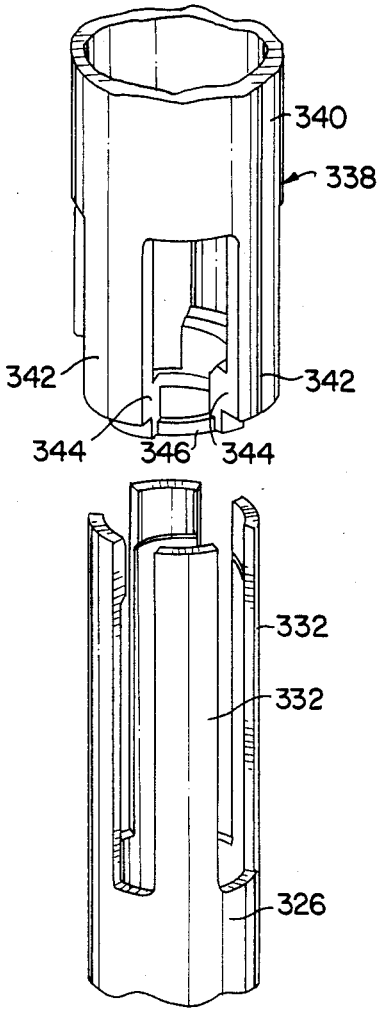
FIG. 12 depicts a portion of the detachable coupling section of FIG. 11 in a perspective view.
Figure 13:
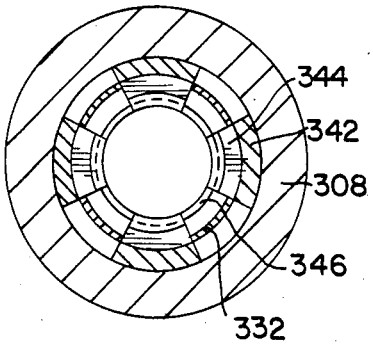
FIG. 13 is a horizontal cross-sectional view of the detachable coupling section taken along line 13—13 of FIG. 11.

A slidable sleeve 338 is positioned between tubing string 12 and inner tubing string 30. Sleeve 338 is shown in greater detail in a perspective view in FIG. 12. Sleeve 338 includes an upper collar 340 and a plurality of downwardly extending fingers 342. Lugs 344 extend inwardly from the lower end of fingers 342 and are joined at the bottom by a ring 346. Sleeve 338 is designed such that collet fingers 332 of downhole section 326 can fit within collar 340 with ring 346 being positioned within the collet fingers. This arrangement is illustrated in greater detail in FIG. 13 which is a cross-sectional view taken along line 13—13 of FIG. 11.

Reference is next made to FIG. 14 which illustrates the pressure responsive means 24 of FIG. 2 in the activated position. In order to activate piston 46, a pressure differential is created between the interior of tubing string 12 and the upper annulus section 20. This can be accomplished either by pressurizing upper annulus section 20 or by reducing the pressure within tubing string 12. When the pressure in upper annulus section 20 is greater than the pressure in tubing string 12, it enters through ports 60 and exerts a force upon shoulders 62 and 64 of piston 46. When a predetermined force is achieved, piston 46 severs shear pins 70 and 72 and rises within axial chamber 44 until it abuts shoulder 45. At this point, ring 66 can drop down until it rests on top of lower section 36. O-rings 54 still provide a seal between piston 46 and lower section 36 to isolate the interior of tubing string 12 from upper annulus section 20.

As piston 46 rises within chamber 44, it pulls inner tubing string 30 upward to activate the firing head as discussed further below.

Reference is now made to FIG. 15 which illustrates packer 16 in the engaged position such that packing element 86 creates a seal dividing the annulus into upper annulus section 20 and lower annulus section 22. The operation of packer 16 will depend on the type of packer selected. Suitable packers and their mode of operation are well known to those skilled in the art.

Figure 16A:
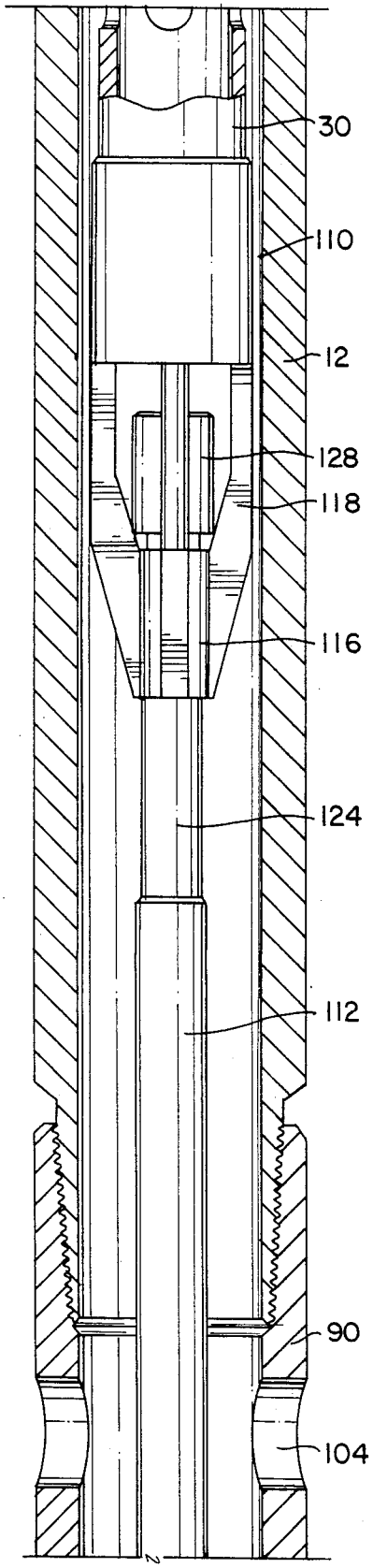
FIGS. 16A and 16B depict the firing head of FIGS. 4A and 4B in the deployed mode.
Figure 16B:
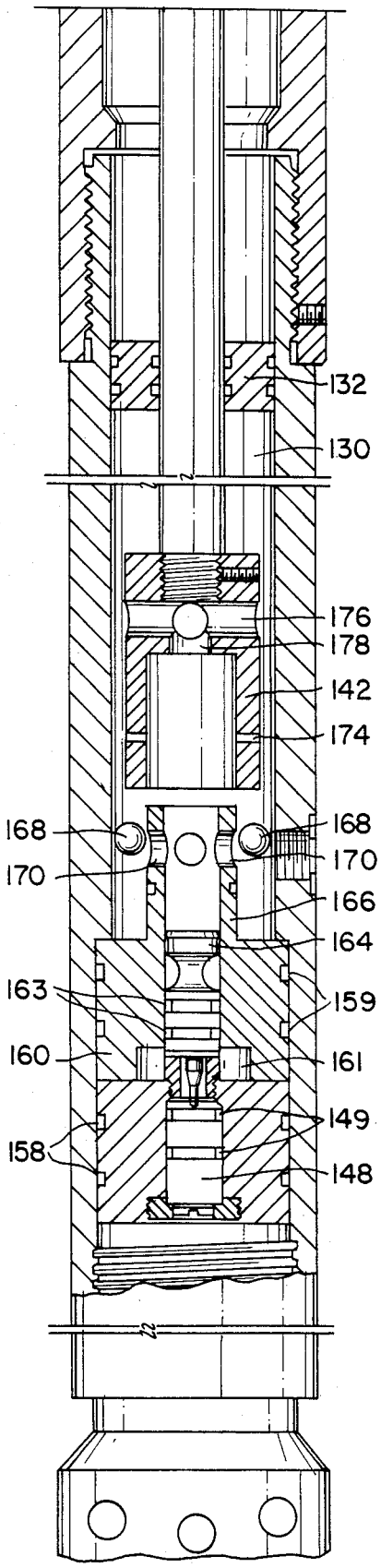

Reference is next made to FIGS. 16A and 16B which illustrate firing head 26 in the engaged position. As inner tubing string 30 is raised by piston 46, it pulls coupler 110 upward until lower collar 116 engages cap 128. Further upward movement then causes pull rod 112 to be pulled upward.

As pull rod 112 rises, it pulls retaining cap 142 off of upper portion 166 of firing pin retainer 160. During this movement, shear pins 174 are severed. In the preferred embodiment, shear pins 174 are designed to break at a force much less than the shear pins which retain the piston 46 in pressure responsive means 24. Accordingly, once piston 46 begins to rise, shear pins 174 will be severed.

Once retaining cap 142 has been raised above ports 170, steel balls 168 are forced outward. Hydraulic fluid entering through ports 176 and axial bore 178 then force firing pin 164 downward where it strikes detonating charge 148.

Piston 132 which surrounds pull rod 112 is shown depressed from its static position. As firing head 26 is lowered into a well, the pressure in the lower annulus section 22 and in the interior of tubing string 12 increases causing piston 132 to slide downward and compress the fluid contained in inner chamber 130. This causes the pressure necessary to actuate firing pin 164.

An atmospheric chamber 161 is formed in the lower portion of firing pin retainer 160 and receives the compressed air created as firing pin 164 decends. Atmospheric chamber 161 is isolated from the other pressures in the bottom of the system by the O-rings 158 in charge retainer 152 and O-rings 149 in detonating charge 148. Chamber 161 is isolated on the top by O-rings 163 on firing pin 164 and O-rings 159 on firing pin retainer 160.

Figure 17:
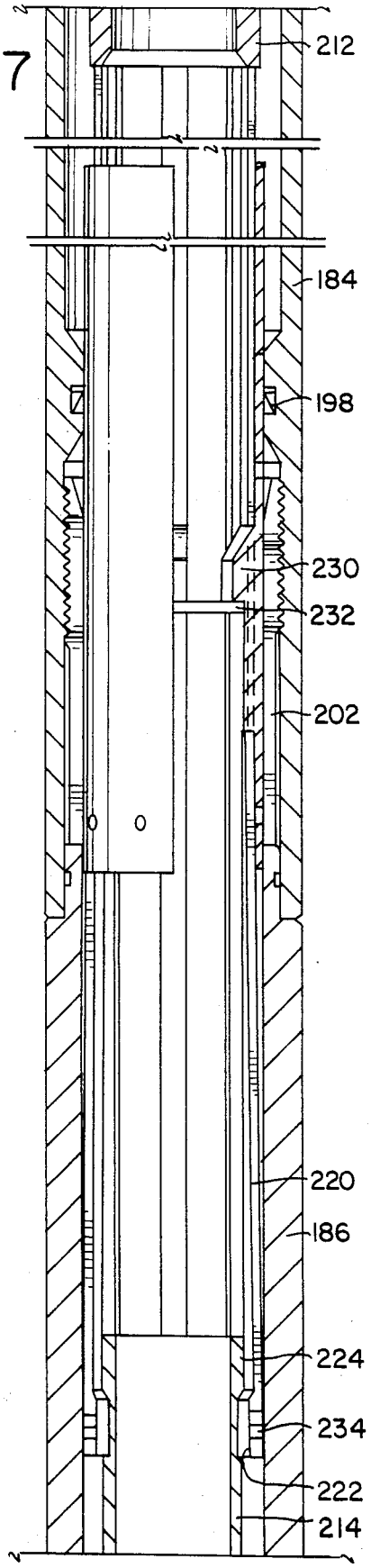
FIG. 17 illustrates the detachable coupling section of FIGS. 7A and 7B in the partically deployed mode.

Reference is next made to FIG. 17 which illustrates the method of activation of detachable coupling section 32 of FIGS. 7A and 7B. A positioning tool such as an Otis Model B Positioning Tool (not shown) is lowered down through tubing string 12 and inner tubing string 30 until it engages ring 232 positioned on the bottom of lugs 230 of sleeve 228. The positioning tool is then pulled uphole on the slickline. As it is pulled upward, it causes sleeve 228 to slide upward between tubing string 123 and inner tubing string 30.

Once sleeve 228 has been pulled to the position illustrated in FIG. 17, collet fingers 220 can spring outward until inwardly extending rim 222 disengage from outwardly extending lugs 224. Downhole section 214 is then free to drop downward within tubing string 12. This downward movement is allowed as coupler 110 (see FIG. 4A) slides down on the section 124 of pull rod 112 having a reduced diameter.

As sleeve 228 is pulled upward, it engages the tapered surface of split ring 198 causing the ring to open to allow sleeve 228 to pass. As sleeve 228 is raised to the position illustrated in FIG. 18, split ring 198 returns to its normal position to prevent sleeve 228 from falling downhole.

Figure 18:
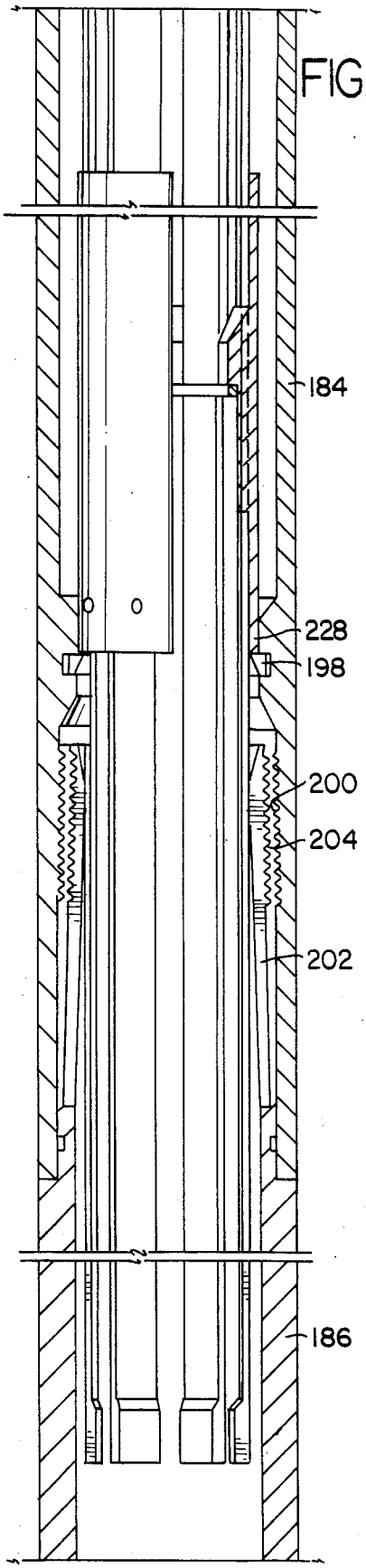
FIG. 18 depicts the detachable coupling section of FIGS. 7A and 7B in the fully deployed mode.

With sleeve 228 in the position illustrated in FIG. 18, collet fingers 202 on downhole section 186 of tubing string 12 spring inwardly releasing serrated surfaces 200 and 204 such that down hold section 186 can fall to the bottom of the well with the perforating gun and firing head. At this point in time, the bottom of tubing string 12 is formed by uphole section 184 and the bottom of inner tubing string 30 is formed by uphole section 212. These sections are completely open, allowing other tools to be lowered down through the tubing strings into the well.

Figure 19:
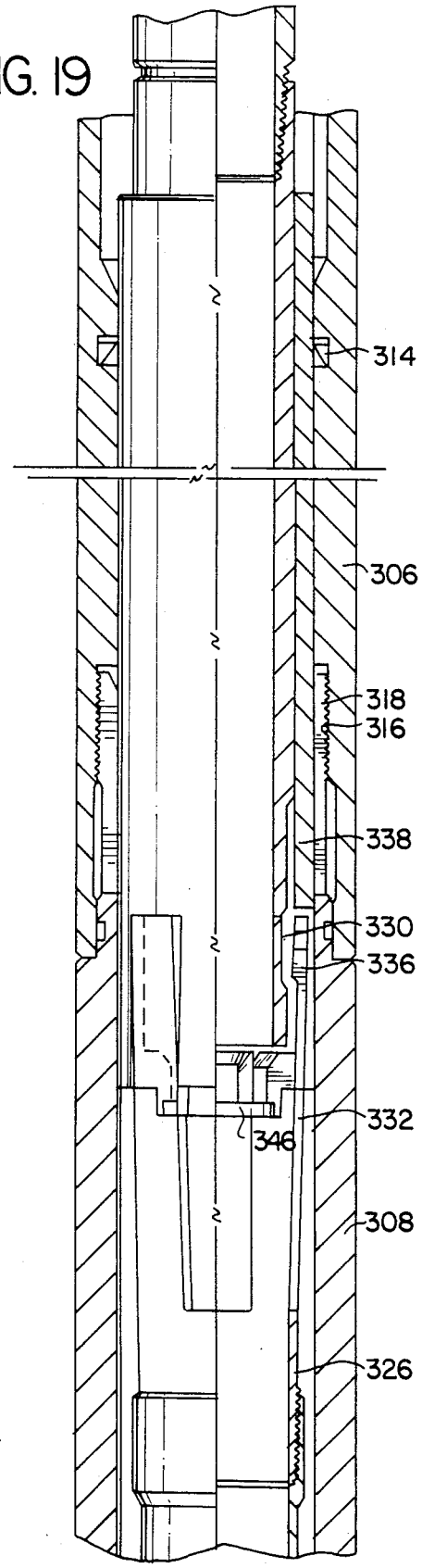
FIG. 19 illustrates the detachable coupling section of FIG. 11 in a partically deployed mode.
Figure 20:
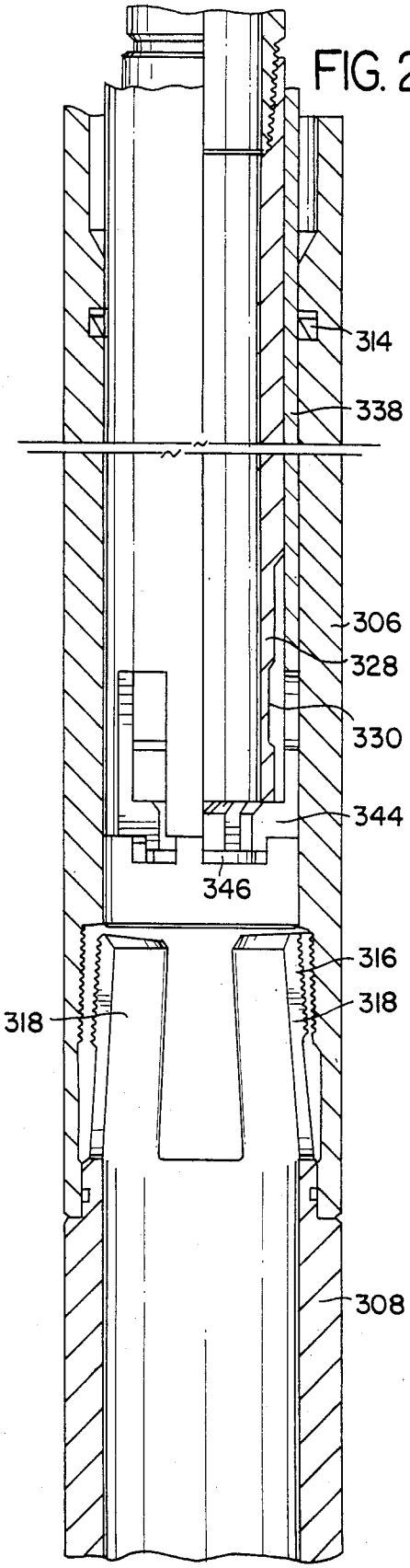
FIG. 20 depicts the detachable coupling section of FIG. 11 in the fully deployed mode.

Reference is next made to FIGS. 19 and 20 which illustrate the operation of the detachable coupling section 32 illustrated in FIG. 11. As with the detachable coupling section illustrated in FIGS. 17 and 18, a positioning tool is lowered on a wireline through tubing string 12 and inner tubing string 30 until it engages ring 346 on sleeve 338. Sleeve 338 can then be pulled upward between tubing string 12 and inner tubing string 30.

When collar 338 is raised to the position illustrated in FIG. 19, collet fingers 332 can spring outward through the apertures formed between fingers 342 in sleeve 338. At this point, lugs 336 on collet fingers 332 disengage from annular groove 330 and allow downhole section 326 to fall down within tubing string 12.

As sleeve 338 is raised higher to the position illustrated in FIG. 20, collet fingers 318 on downhole section 308 of tubing string 12 can spring inwardly to disengage the serrated surface 316 and allow downhole section 308 to fall to the bottom of the well along with the perforating gun and firing head. Sleeve 338 can then be pulled further upward until it passes split ring 314 which prevents sleeve 338 from falling down in the hole.

While the invention has been illustrated with respect to the presently preferred embodiments, it will be appreciated that numerous modifications and changes could be made without departing from the spirit or essential characteristics of the invention. For example, rather than using a mechanical linkage to activate the sleeves in detachable coupling 32, hydrostatic pressure can be used by including a piston which is connected to the sleeve and by lowering a tool containing an air chamber to actuate the piston. Other modifications and changes to the invention will be apparent to those skilled in the art. Accordingly, all changes or modifications which come within the meaning and range of equivalency of the claims are to be embraced within their scope.

We claim:

1. A system for perforating a well having a casing therein, said well intersecting at least one fluid bearing formation of the earth and having fluid therein, said system comprising:

a first tubing string suspended within said casing in said well;

a perforating gun having a firing mechanism, said gun being suspended on an end of said first tubing string and forming perforations in said casing in said well upon actuation thereof;

means positioned above said perforating gun for dividing an annulus formed between said casing in said well and said first tubing string into upper and lower sections;

means for creating a pressure differential between said upper section of said annulus and the interior of said tubing string;

means in fluid communication with said upper section of said annulus for producing a force in response to said pressure differential; and a second tubing string positioned in and concentric with said first tubing string, said second tubing string being connected to said force producing means for transmitting said force from said producing means to said firing mechanism for the actuation thereof and the actuation of said perforating gun to form perforations in said casing in said well and having an unobstructed bore therethrough.

2. A system for perforating a well as defined in claim 1 wherein said dividing means comprises a packer.

3. A system for perforating a well as defined in claim 1 wherein said means for creating a pressure differential comprises means for lowering the pressure within said first tubing string.

4. A system for perforating a well as defined in claim 1 wherein said means for creating a pressure differential comprises means for increasing the pressure in said upper section of said annulus.

5. A system for perforating a well as defined in claim 1 wherein said force producing means comprises a piston positioned in a chamber formed between the interior of said first tubing string and said second tubing string and being in fluid communication with said upper section of said annulus, said piston isolating the interior of said first tubing string from fluid flow therethrough from said upper section of said annulus.

6. A system for perforating a well as defined in claim 1 further comprising means for separating said first and second tubing strings into upper and lower sections at a point below said dividing means such that the lower sections can be dropped into the well.

7. A system for perforating a well as defined in claim 6 wherein said separating means comprises:

a first detachable coupling connecting upper and lower sections of said first tubing string;

a second detachable coupling connecting upper and lower sections of said second tubing string;

a movable sleeve positioned between said first and second detachable couplings; and means for moving said sleeve to release said first and second couplings.

8. A system for perforating a well as defined in claim 7 wherein said means for moving said sleeve comprises lugs extending from said sleeve into the interior of said second tubing string.

9. A system for perforating a well as defined in claim 1 wherein said second tubing string includes means for permitting the flow of fluids from said lower annulus section through the second tubing string into the first tubing string.

* * * * *